US009599072B2

(12) United States Patent
Dudar

(10) Patent No.: US 9,599,072 B2
(45) Date of Patent: Mar. 21, 2017

(54) SYSTEM AND METHODS FOR PURGING A FUEL VAPOR CANISTER BUFFER

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 364 days.

(21) Appl. No.: 14/284,238

(22) Filed: May 21, 2014

(65) Prior Publication Data

US 2015/0337775 A1 Nov. 26, 2015

(51) Int. Cl.
*F02M 25/08* (2006.01)

(52) U.S. Cl.
CPC ..... *F02M 25/089* (2013.01); *F02M 25/08* (2013.01)

(58) Field of Classification Search
CPC ..... F02M 25/089; F02M 25/0836; F02M 25/0809; F02M 2025/0845; F02M 25/08
See application file for complete search history.

(56) References Cited

U.S. PATENT DOCUMENTS 5,056,570 A * 10/1991 Harris ..... B60K 15/03519 141/302
7,343,904 B2 3/2008 Jo
2013/0184963 A1 7/2013 Jackson et al.
2014/0116402 A1* 5/2014 Horiba ..... F02M 25/0836 123/520

FOREIGN PATENT DOCUMENTS

WO 2012175456 A2 12/2012

OTHER PUBLICATIONS

Anonymous, "Method to reduce fuel volatility in PHEV vehicles to improve Evap monitor robustness and emissions," IPCOM No. 000238130D, Published Aug. 4, 2014, 2 pages.
Anonymous, "A Method to Wakeup PCM During Refueling Event," IPCOM No. 000240456, Published Jan. 30, 2015, 2 pages.
Hannon, Elliot, "Maza Issues Most Terrifying Car Recall of All—Some Models Vulnerable to Spider Attack," http://www.slate.com/blogs/the_slatest/2014/04/07/mazda_issues_recall_because_spiders_invade_fuel_tank_causing_fire_risk.html, Apr. 7, 2014, pp. 1-3.

* cited by examiner

*Primary Examiner* — Jacob Amick
(74) *Attorney, Agent, or Firm* — James Dottavio; John D. Russell; B. Anna McCoy

(57) ABSTRACT

A method for purging a fuel vapor canister buffer, comprising: opening a fuel tank isolation valve; opening a canister purge valve; and drawing a vacuum on a fuel tank sufficient to open a capless refueling assembly vacuum relief mechanism. In this way, the fuel vapor canister buffer may still be purged to intake even under conditions where the canister vent line is blocked.

19 Claims, 5 Drawing Sheets

SYSTEM AND METHODS FOR PURGING A FUEL VAPOR CANISTER BUFFER

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel vapor canister. Simultaneously, a canister vent valve coupled in a vent line between the fuel vapor canister and atmosphere is opened, allowing for fresh air to enter the canister. This configuration facilitates desorption of stored fuel vapors from the adsorbent material in the canister, regenerating the adsorbent material for further fuel vapor adsorption.

However, the vent line is prone to becoming blocked or clogged over time, as dirt, salt, spiders, etc., accumulate in the vent line and/or an air filter positioned in the vent line. If the vent line is blocked, fresh air cannot be drawn on the fuel vapor canister. The canister cannot be purged, yet fuel vapor will continue to be adsorbed within the canister until the adsorbent is saturated. This will lead to an increase in bleed emissions.

The inventors herein have recognized the above problems, and have developed systems and methods to at least partially address them. In one example, a method for purging a fuel vapor canister buffer, comprising: opening a fuel tank isolation valve; opening a canister purge valve; and drawing a vacuum on a fuel tank sufficient to open a capless refueling assembly vacuum relief mechanism. In this way, the fuel vapor canister buffer may still be purged to intake even under conditions where the canister vent line is blocked.

In another example, a fuel system for a vehicle, comprising: a fuel tank coupled to a buffer of a fuel vapor canister; a capless refueling assembly coupled to the fuel tank, the capless refueling assembly configured to vent to atmosphere responsive to a fuel tank vacuum increasing above a threshold vacuum; an engine intake coupled to the fuel vapor canister; and a controller configured with instructions stored in non-transitory memory, that when executed, cause the controller to: during a first condition, apply a vacuum from the engine intake to the fuel tank such that the capless refueling assembly vents to atmosphere; and maintain applying vacuum from the engine intake to the fuel tank until a load of the buffer of the fuel vapor canister decreases below a threshold. In this way, the canister may be partially purged to intake. Following a diurnal cycle, the fuel vapor remaining in the canister may migrate into the canister buffer. The cycle may then be repeated. In this way, the contents of the canister may be gradually purged to intake, decreasing bleed emissions that would otherwise occur if the vent line is blocked.

In yet another example, a method for purging a fuel vapor canister, comprising: during a first condition, opening a fuel tank isolation valve; ramping up a canister purge valve duty cycle until a capless refueling assembly vents to atmosphere; drawing atmospheric air into the engine intake via a path that includes the capless refueling assembly, the fuel tank, and the fuel vapor canister buffer; drawing fuel vapor desorbed from the fuel vapor canister buffer into the engine intake; maintaining the canister purge valve duty cycle until an exhaust gas oxygen sensor indicates a richness of exhaust has decreased below a threshold; and then closing the fuel tank isolation valve and canister purge valve. In this way, a secondary canister vent pathway may be realized without adding any additional hardware and thus without increasing manufacturing costs.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

This detailed description relates to systems and methods for purging a fuel vapor canister. In particular, the description relates to systems and methods for purging a fuel vapor canister when a canister vent line is blocked or clogged. The fuel vapor canister may be incorporated in the fuel system of a vehicle, such as the fuel system and vehicle system depicted in FIG. 1. The fuel system may further comprise a capless refueling assembly, such as the assembly depicted in FIG. 2. In the event that the vent line is blocked or clogged, a buffer region of the fuel vapor canister may be purged to intake by drawing a vacuum on the fuel tank sufficient to trigger the vacuum relief mechanism of the capless refueling assembly, as shown by the method of FIG. 3. After purging the canister buffer, fuel vapor may migrate from the fuel vapor canister into the buffer, at which point the buffer may be purged again. FIGS. 4A-4D show schematic drawings of the fuel vapor canister and canister buffer over time using the method of FIG. 3. FIG. 5 shows an example timeline for a vehicle executing a purge in accordance with the present disclosure.

Figure 1:
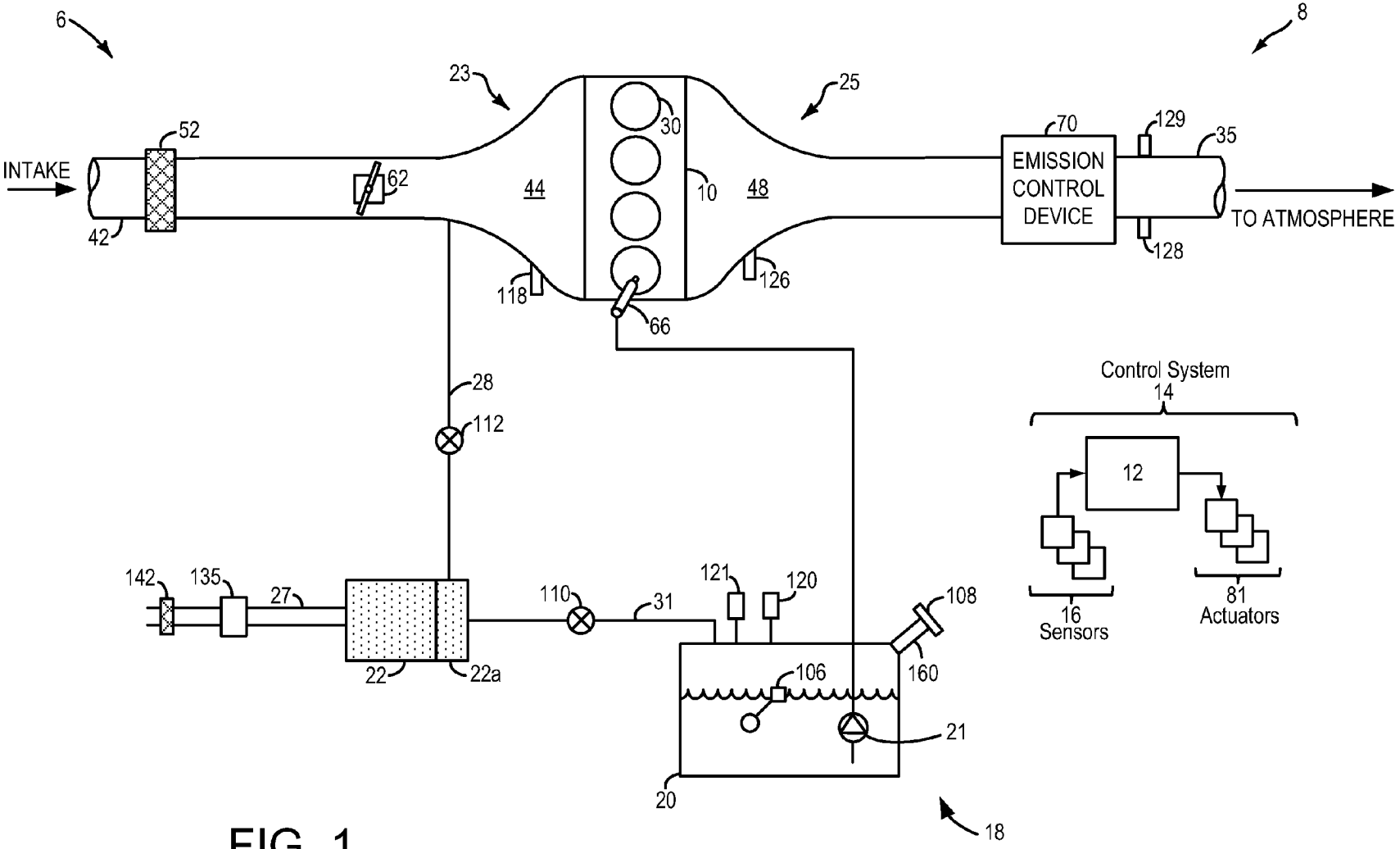
FIG. 1 shows a schematic depiction of a fuel system coupled to an engine system.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling assembly 108. Refueling assembly 108 and the fuel tank 20 may be in fluidic communication via fuel passage 160. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used. Refueling assembly 108 may include a number of components configured to enable capless refueling, decrease air entrapment in the assembly, decrease the likelihood of premature nozzle shut-off during refueling, as well as increase the pressure differential in the fuel tank over an entire refueling operation, thereby decreasing the duration of refueling. A detailed schematic of one example configuration for refueling assembly 108, comprising a capless refueling assembly is described herein and with regards to FIG. 2.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. An air filter 142 may be coupled in vent 27 between canister 22 and atmosphere.

Canister 22 may include a buffer **22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, when purging canister 22 with air drawn through vent 27**, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include HEGO sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, isolation valve 110, purge valve 112, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIG. 3.

Leak detection routines may be intermittently performed by controller 12 on fuel system 18 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 135 communicatively coupled to controller 12. ELCM 135 may be coupled in vent 27, between canister 22 and the atmosphere. ELCM 135 may include a vacuum pump for applying negative pressure to the fuel system when administering a leak test. ELCM 135 may further include a reference orifice and a pressure sensor. Following the applying of vacuum to the fuel system, a change in pressure at the reference orifice (e.g., an absolute change or a rate of change) may be monitored and compared to a threshold. Based on the comparison, a fuel system leak may be diagnosed. ELCM 135 may comprise a change-over valve operable between a first and second position. When in the first position, the changeover valve may couple the canister to atmosphere, allowing for atmospheric air to be drawn on the fuel vapor canister, and for air stripped of fuel vapor to be vented to atmosphere, for example, during a refueling event. While in the first position, activating the vacuum pump may cause a vacuum to be drawn on the reference orifice. While in the second position, the change-over valve may couple the canister to atmosphere via the vacuum pump. In this position, activating the vacuum pump may cause a vacuum to be drawn on the fuel vapor canister. If the fuel tank isolation valve is open, a vacuum may be drawn on the fuel tank.

Figure 2:
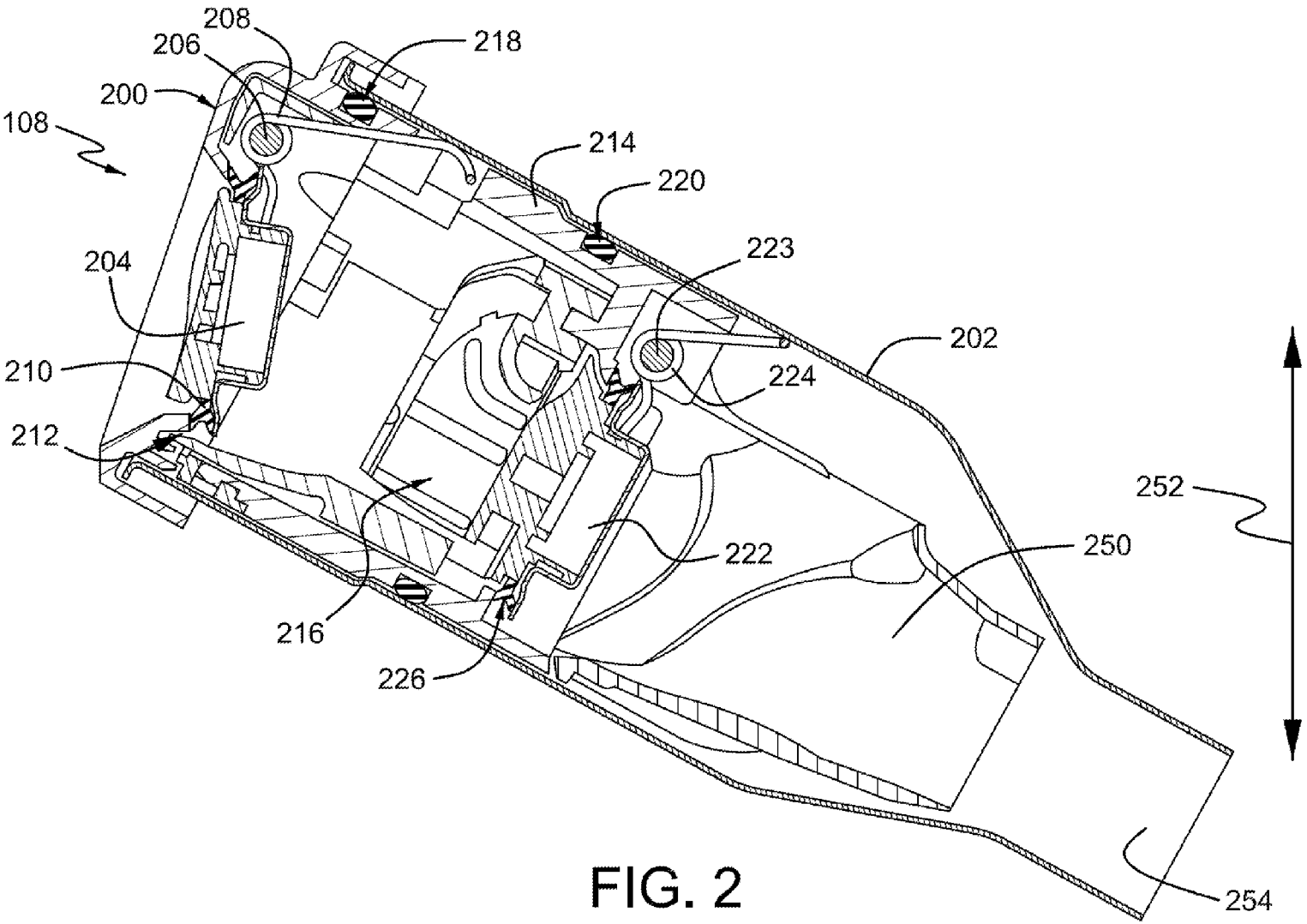
FIG. 2 shows an illustration of a capless refueling assembly for the fuel system of FIG. 1.
Figure 3:
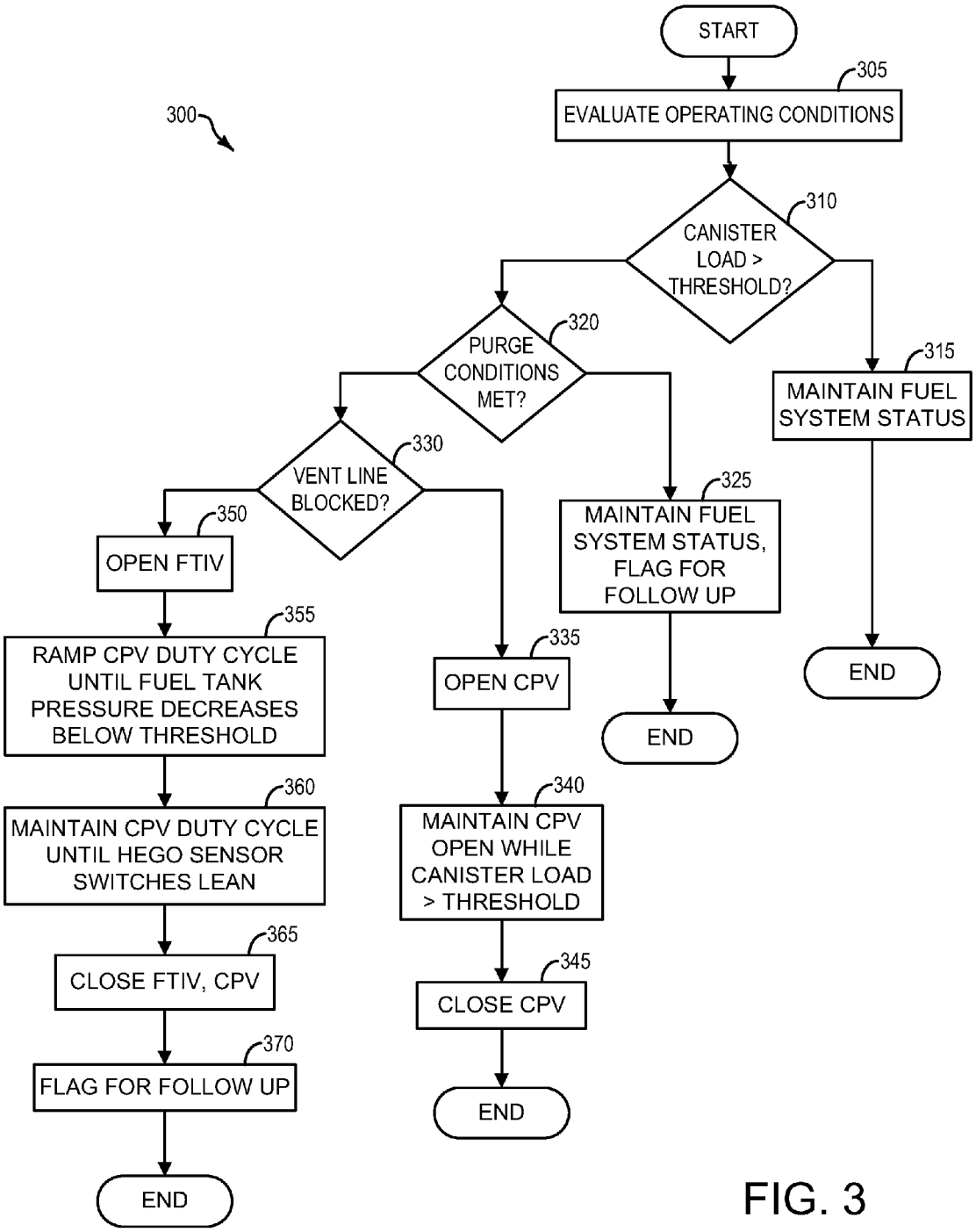
FIG. 3 shows a flow chart for a high-level method for purging a fuel vapor canister.

FIG. 2 shows an example capless refueling assembly 108. The refueling assembly 108 includes a cover 200. The cover 200 is configured to enclose components in the assembly. The refueling assembly further includes an external housing 202 configured to at least partially enclose various internal components of the refueling assembly 108. The refueling assembly 108 further includes an upstream door 204 having a hinge 206. The upstream door 204 is inset from the cover 200. A preloaded upstream spring 208 may be coupled to the upstream door 204 and the external housing 202. The preloaded upstream spring 208 coupled to the upstream door 204 providing a return force to the door when opened. The upstream spring 208 is configured to provide a return force when the upstream door 204 is depressed via a fuel nozzle. In this way, the upstream door 204 may close after a fuel nozzle is removed during a refueling event. Thus, the upstream door 204 automatically closes without assistance from a refueling operator. As a result, the refueling process is simplified.

A seal 210 may be attached to the upstream door 204. Specifically, the seal 210 may extend around the periphery of the upstream door 204, in some examples. When the upstream door 204 is in a closed position the seal may be in face sharing contact with the cover 200. In this way, the evaporative emissions from the refueling assembly 108 are reduced.

The refueling assembly 108 further includes a locking lip 212. The locking lip 212 may be configured to receive a portion of a fuel nozzle. In some examples, the locking lip 212 may be provided around at least 100° of the inside circumference of the refueling assembly 108. The locking lip 212 may influence the positioning and angle of the fuel nozzle axis spout during refueling and therefore has an impact on filling performance.

The refueling assembly 108 further includes an internal housing 214. The walls of the internal housing 214 may define a nozzle enclosure configured to receive a fuel nozzle. The internal housing 214 may also include a nozzle stop actuator 216 configured to actuate a portion of the fuel nozzle that initiate fuel flow from the fuel nozzle.

An upstream body seal 218 and a downstream body seal 220 may be provided in the refueling assembly 108 to seal the external housing 202 and various internal components in the refueling assembly 108. Specifically, the upstream and downstream body seals (218 and 220) are configured to extend between the external housing 202 and the internal housing 214. The upstream body seal 218 and/or downstream body seal 220 may be an O-ring in some examples.

The refueling assembly 108 further includes a downstream door 222 positioned downstream of the upstream door 204 and the nozzle stop actuator 216. The downstream door 222 includes a hinge 223 and has a preloaded downstream spring 224 coupled thereto. The preloaded downstream spring 224 is coupled to the downstream door 222 providing a return force to the downstream door 222 when opened The downstream spring 224 is also coupled to the external housing 202. The spring 224 is configured to provide a return force to the downstream door 222 when the downstream door 222 is in an open position. The downstream door 222 may also include a seal 226 (e.g., flap seal). The seal 226 may be positioned around the periphery of the downstream door 222, in some examples. The downstream door 222 enables the evaporative emissions during the refueling process to be further reduced. The downstream door 222 is arranged perpendicular to the fuel flow when closed, in the depicted example. However, other orientations of the downstream door 222 are possible.

Refueling assembly 108 may be positioned in a number of configurations in the vehicle 100, shown in FIG. 1. In one example, refueling assembly 108 has a downward gradient. In other words, upstream door 204 is positioned vertically above flow guide 250 with regard to gravitational axis 252. In this way, fuel flow is assisted via gravity during refueling operation.

Refueling assembly 108 includes flow guide 250 which is arranged downstream of downstream door 222. Refueling assembly 108 further includes filler pipe 254. Flow guide 250 may be at least partially enclosed by filler pipe 254. Filler pipe 254 is in fluidic communication with fuel tank 104 via fuel passage 160, as shown in FIG. 1.

Refueling assembly 108 may further include a vacuum relief mechanism (not shown). The vacuum relief mechanism may allow a passage in refueling assembly 108 to open under a threshold vacuum, allowing for the venting of fuel tank 20 to atmosphere. In this way, an excess of fuel tank vacuum will cause the vacuum relief mechanism to vent to atmosphere, preventing the fuel tank from collapsing. The vacuum threshold for activating the vacuum relief mechanism may be set at −20 in H2O, for example, or at a suitable threshold depending on the fuel tank design and configuration. The vacuum threshold may also be set at a level greater than vacuum conditions typically used for fuel tank leak testing using ELCM 135. For example, the vacuum threshold may be set above −12 in$H_2O$, for example, or at a suitable level depending on the configuration of ELCM 135. In this way, an ELCM testing cycle may not trigger the vacuum relief mechanism (which may cause a false fail result), but such that naturally occurring tank vacuum above a threshold may be relieved. In some embodiments, the vacuum relief mechanism may not be an additional hardware component within refueling assembly 108. Rather, preloaded upstream spring 208 and preloaded downstream spring 224 may be set with a tension such that fuel tank vacuum above a threshold (e.g. −20 in$H_2O$) will cause upstream door 204 and downstream door 222 to open, venting fuel tank 20 to atmosphere. In some embodiments, preloaded upstream spring 208 and preloaded downstream spring 224 may be solenoid activated springs under control of controller 12. When fuel tank vacuum increases above the threshold vacuum (as determined by fuel tank pressure sensor 120, for example) controller 12 may deactivate the solenoids, allowing for upstream door 204 and downstream door 222 to open, venting fuel tank 20 to atmosphere. Upon fuel tank vacuum reaching a threshold level, the solenoids may be re-activated.

Referring back to FIG. 1, purging fuel vapor canister 22 is typically dependent on fresh air drawn through vent line 27. However, vent line 27, and air filter 142 are prone to clogging over time. Dirt, salt, spiders, etc. may cause blockages in vent line 27, preventing fresh air from being drawn on canister 22. If fresh air cannot be drawn on canister 22, fuel vapor will continue to amass within the canister, saturating the adsorbent and leading to bleed emissions.

FIG. 3 shows a flow chart for a high-level method 300 for purging a fuel vapor canister. In particular, FIG. 3 depicts a method for purging a fuel vapor canister during conditions when vent line 27 is blocked, by using the vacuum relief mechanism of capless refueling assembly 108 to draw air on canister buffer 22*a* via fuel tank 20. Method 300 will be described herein with reference to the components and systems depicted in FIGS. 1 and 2, though it should be understood that the method may be applied to other systems without departing from the scope of this disclosure. Method 300 may be carried out by controller 12, and may be stored as executable instructions in non-transitory memory.

Method 300 may begin at 305. At 305, method 300 may include evaluating operating conditions. Operating conditions may include, but are not limited to, vehicle conditions such as fuel fill level, canister load level, engine operating status, intake manifold pressure, etc., as well as ambient conditions, such as temperature, humidity, barometric pressure, etc. Operating conditions may be measured by one or more sensors 16 coupled to controller 12, or may be estimated or inferred based on available data.

Continuing at 310, method 300 may include determining whether the content of fuel vapor canister 22 is above a threshold. In other words, method 300 may include determining whether vapor canister 22 is saturated with hydrocarbon fuel vapor, and/or at or above a content level where purging is recommended. Determining whether the content of fuel vapor canister 22 is above a threshold may include determining a hydrocarbon percentage or oxygen percentage from a sensor coupled to canister 22, for example. In another example, controller 12 may determine a quantity of fuel vapor vented to canister 22 since the last purge event based on flow rates through FTIV 110. In another example, controller 12 may determine a quantity of fuel vapor vented to canister 22 since the last purge event based on temperature changes at the canister during fuel tank venting since the last purge event.

If the fuel vapor canister load is determined to be less than the threshold, method 300 may proceed to 315. At 315, method 300 may include maintaining the status of the fuel system. Method 300 may then end.

If the canister load is determined to be above a threshold, method 300 may proceed to 320. At 320, method 300 may include determining whether purge conditions are met. Purge conditions may include an engine-on status, an intake manifold vacuum above a threshold, a non-steady-state engine condition (e.g. engine is not idling), or other operating conditions conducive to purging the fuel vapor canister. If purge conditions are not met, method 300 may proceed to 325. At 325, method 300 may include maintaining the status of the fuel system, and may further include setting a flag for follow-up. The flag may indicate to controller 12 that method 300 or another method for purging the fuel vapor canister should be executed when purge conditions are met. Method 300 may then end.

If purge conditions are met, method 300 may proceed to 330. At 330, method 300 may include determining whether the vent line is blocked. Determining whether the vent line is blocked may include retrieving an error code stored at controller 12. A vent line blockage error code may be set as the result of a vent line blockage test, a failed purge event, etc. For example, a pressure sensor within ELCM 135 may determine that air flow is impeded during a purge routine, and indicate to controller 12 to set an error code. In another example, a temperature sensor coupled within fuel vapor canister 22 may determine that no temperature decrease occurs during a purge event, suggesting that no fuel vapor is being desorbed. If subsequent test validate that the flow path between the fuel vapor canister and intake is unimpeded, and that the flow path between the fuel tank and intake is unimpeded, a vent line blockage error code may be set. For example, fuel vapor canister 22 may comprise a single temperature sensor coupled at or near the load side of the canister. Following a failed purge, fuel vapor may be vented from fuel tank 20 to fuel vapor canister 22 by opening FTIV 110 and CPV 112. An increase in temperature followed by a decrease in temperature would indicate fuel vapor adsorption (increase) followed by saturation (decrease) and would thus indicate that the fuel vapor canister is functional, and that a vacuum was drawn on the fuel tank, indicating that the CPV is functional.

If it is determined that the vent line is not blocked, method 300 may proceed to 335. At 335, method 300 may include opening the canister purge valve and may further include placing or maintaining the ELCM purge valve in a first position, coupling the fuel vapor canister to atmosphere. Continuing at 340, method 340 may include maintaining the CPV open until the fuel vapor canister load decreases below a threshold. The fuel vapor canister load may be determined via a hydrocarbon or oxygen sensor, or may be determined based on changes in fuel vapor canister temperature as fuel vapor is desorbed. When the fuel vapor canister load has decreased below the threshold, method 300 may proceed to 340. At 340, method 300 may include closing the CPV, and may further include recording the purge event, and may further include recording the canister load following the purging event. Method 300 may then end.

Returning to 330, if it is determined that the vent line is blocked, method 300 may proceed to 350. At 350, method 300 may include opening the FTIV, and thus coupling the fuel tank to canister buffer 22*a*. Continuing at 355, method 300 may include ramping the CPV duty cycle until the fuel tank pressure decreases below a threshold. The fuel tank pressure threshold may be set at or below the vacuum required to vent the fuel tank to atmosphere via the capless refueling assembly. As described with regards to FIG. 2, the capless refueling assembly may vent to atmosphere at a predetermined vacuum in order to prevent the fuel tank from collapsing or deforming. The ventilation may occur via the opening of the upper and lower tank flaps, or may occur through the opening of a separate vacuum relief mechanism coupled between the fuel filler neck and atmosphere. Fuel tank pressure may be monitored by FTPT 120. To ensure the fuel tank vacuum has caused the capless refueling assembly to vent to atmosphere, the CPV duty cycle may be ramped until the HEGO sensor switches rich, indicating that fresh air is drawn on canister buffer 22*a*, thereby desorbing fuel vapor to intake.

When it has been confirmed that the fuel tank is vented to atmosphere via the capless refueling assembly, method 300 may proceed to 360. At 360, method 300 may include maintain the CPV duty cycle until the HEGO sensor switches lean. The HEGO sensor switching lean may indicate that the canister buffer 22*a* has been stripped of adsorbed fuel vapor, as the air entering the engine intake via the CPV no longer contains combustible hydrocarbons.

When the HEGO sensor switches lean, method 300 may proceed to 365. At 365, method 300 may include closing the FTIV and CPV. Method 300 may then proceed to 370.

At 370, method 300 may include setting a flag for follow up. The flag may indicate that a canister buffer purge event has occurred. Although the canister buffer is now stripped of fuel vapor, the rest of canister 22 may still contain adsorbed fuel vapor. Over time, the adsorbed fuel vapor will migrate towards the unbound adsorbent located in the canister buffer. At this point, the canister buffer may be purged again, using the described method. For example, the canister buffer may be purged following a diurnal cycle. The number of purges needed to purge the entire fuel vapor canister may be determined based on the canister load, the canister size, buffer/canister size ratio, or may be determined empirically. Method 300 may then end.

FIGS. 4A-4D schematically show a fuel vapor canister 422 at different progressive stages of a purging event using the method depicted in FIG. 3. Fuel vapor canister 422 comprises a canister buffer 422*a*. Fuel vapor canister 422 may also include a region 422*b* where the concentration of adsorbed fuel vapor is less than for other regions of the canister. Throughout FIGS. 4A-4D, lighter shading represents regions of lower concentration while darker shading represents regions of higher concentration. Vent line 427 couples fuel vapor canister 422 to atmosphere via a vent valve (not shown). Purge line 428 couples canister buffer 422*a* to an engine intake via a purge valve (not shown). Conduit 431 couples canister buffer 422*a* to a fuel tank via a fuel tank isolation valve (not shown). Throughout this example, vent line 427 may be considered to be clogged.

Figure 4A:
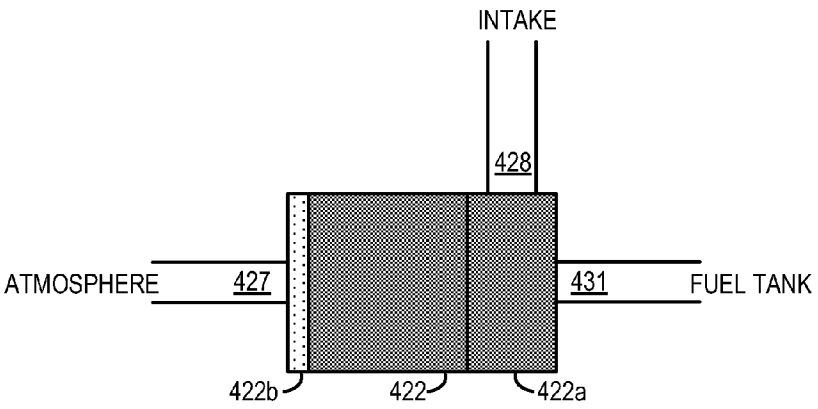
FIGS. 4A-4D show schematic depictions of a fuel vapor canister in different stages of a purge routine.
Figure 5:
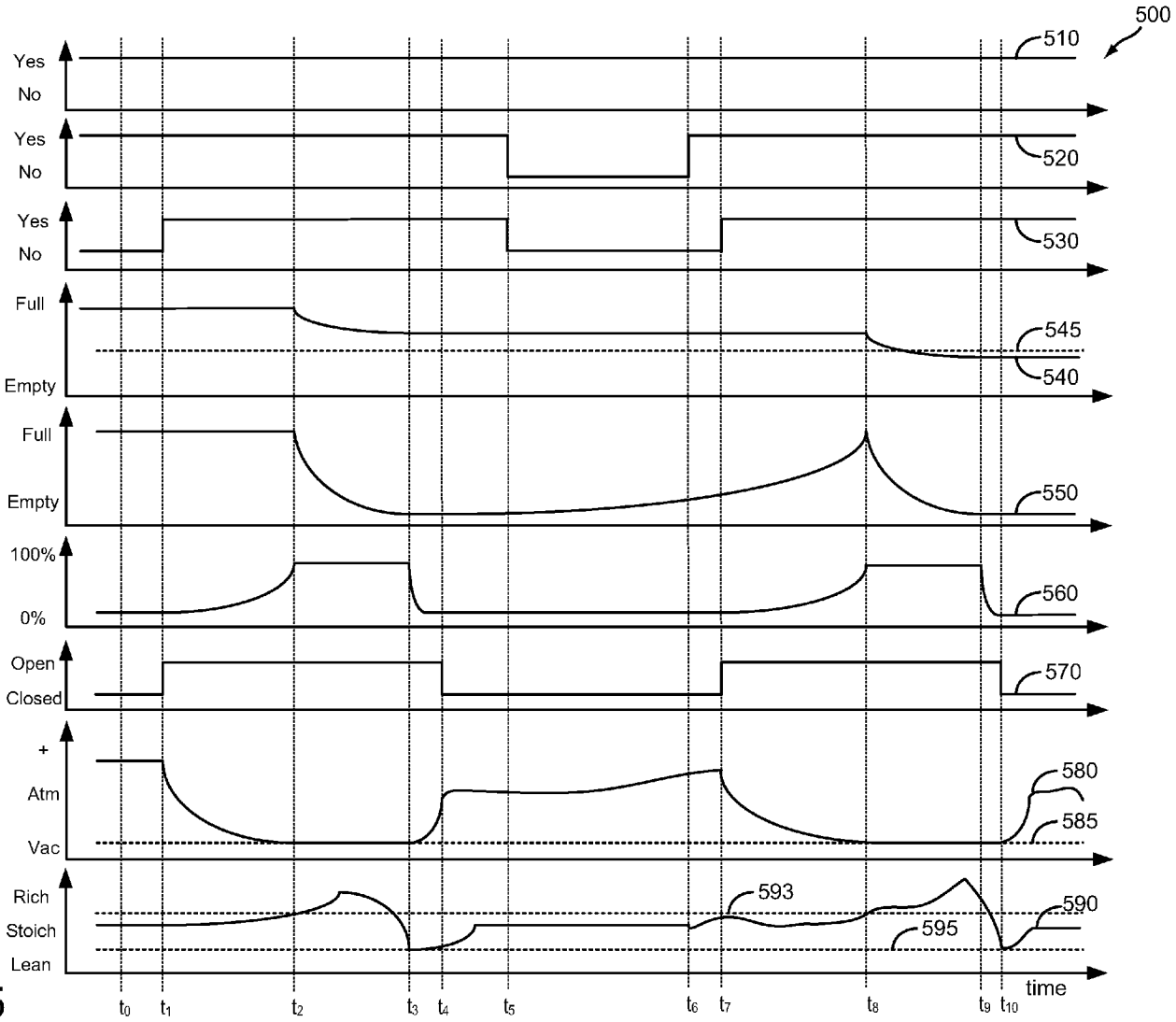
FIG. 5 shows a timeline for a fuel vapor canister purge using the method shown in FIG. 3.

FIG. 4A shows fuel vapor canister 422 and canister buffer 422*a* with a hydrocarbon load above a threshold for purging as described with regard to FIG. 3. Although vent line 427 is blocked, some fresh air may circulate between canister 422 and atmosphere, promoting desorption of some fuel vapor from the vent side of canister 422. Thus, region 422*b* may have a lower fuel vapor concentration than the rest of canister 422.

Figure 4B:
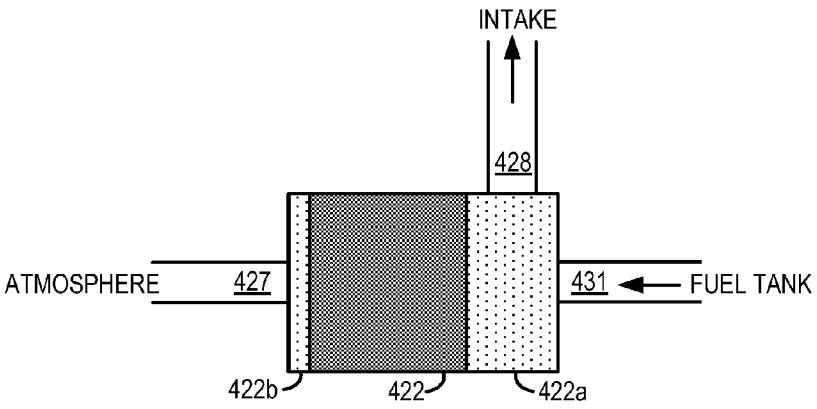

FIG. 4B shows fuel vapor canister 422 and canister buffer 422*a* during a first purging event in accordance with the present disclosure. As vent line 427 is clogged, the secondary purge method is activated, wherein the FTIV is opened and the CPV duty cycle ramped up until a vacuum relief mechanism within a capless refueling unit opens, drawing fresh air into the fuel tank. As such, FIG. 4B shows air flow (arrows) from the fuel tank into canister buffer 422*a*, and from canister buffer 422*a* to intake. In this way, the canister buffer may be stripped of fuel vapor, hence canister buffer 422*a* is depicted as having a lower concentration of fuel vapor in FIG. 4B.

Figure 4C:
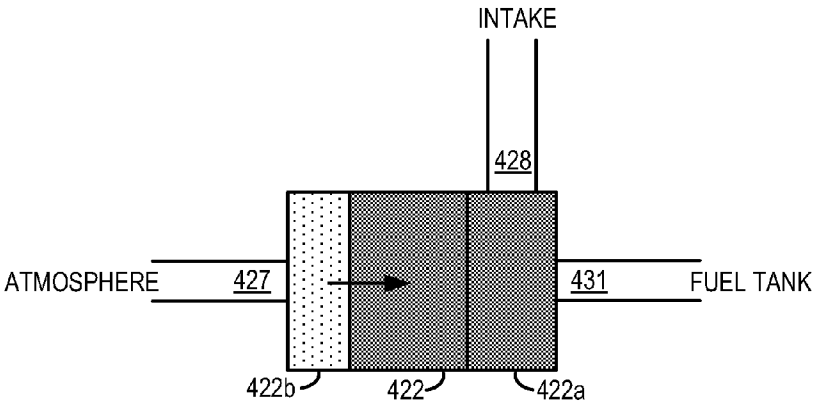

FIG. 4C shows fuel vapor canister 422 and canister buffer 422*a* following a diurnal cycle following the purge event of FIG. 4B. During an overnight soak, fuel vapor will migrate (as indicated by the arrow) from fuel vapor canister 422 to canister buffer 422*a*. Accordingly, region 422*b* is now expanded, and canister buffer 422*a* now has an increased fuel vapor concentration. During the overnight soak, the FTIV is closed. If the fuel tank vacuum decreases below a threshold (e.g. due to the bulk fuel cooling), the vacuum relief mechanism within the capless refueling unit may still open, drawing atmospheric air into the fuel tank, but not into the fuel vapor canister buffer or the engine intake.

Figure 4D:
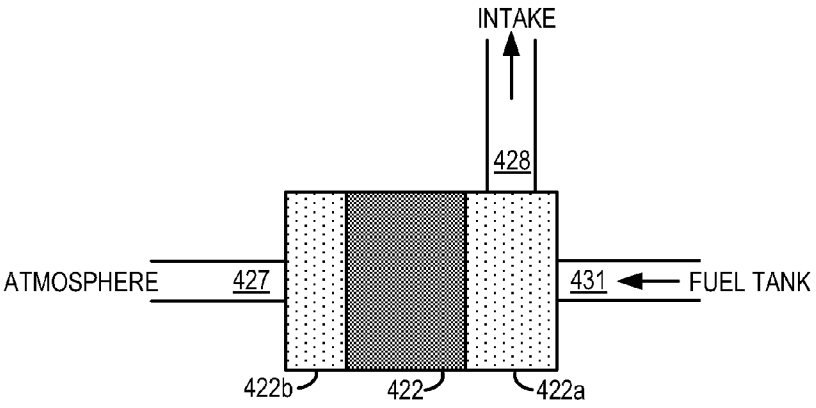

FIG. 4D shows fuel vapor canister 422 and canister buffer 422*a* during a second purging event following the diurnal cycle of FIG. 4C. Again, the FTIV is opened and the CPV duty cycle ramped up until a vacuum relief mechanism within a capless refueling unit opens, drawing fresh air into the fuel tank, where it will subsequently flow to intake via canister buffer 422*a* (arrows). The canister may thus again be stripped of fuel vapor. This cycle of purging the canister buffer, then allowing the residual fuel vapor to migrate into the buffer where they may be purged to intake may be repeated until the canister is cleaned.

FIG. 5 shows an example timeline 500 for a canister purge event using the method described herein and with regard to FIG. 3, applied to the systems described herein and with regard to FIGS. 1, 2, and 4. Timeline 500 includes plot 510, indicating whether a vent line is clogged over time. Timeline 500 further includes plot 520, indicating whether a vehicle engine is on over time; and plot 530, indicating whether purge conditions are met over time. Timeline 500 includes plot 540, indicating a total canister load over time, while line 545 represents a canister load threshold. Timeline 500 further includes plot 550, indicating a canister buffer load over time. Timeline 500 includes plot 560, indicating a CPV duty cycle over time, and plot 570, indicating the status of an FTIV over time. Timeline 500 further includes plot 580, indicating a fuel tank pressure over time, while line 585 represents a fuel tank vacuum threshold. Timeline 500 further includes plot 590, indicating a relative output signal of an HEGO sensor over time, while line 583 represents a rich HEGO output threshold, and line 585 represents a lean HEGO output threshold.

At time $t_0$, the vehicle engine is on, as indicated by plot 520, and the canister load is above a threshold for purging, as indicated by plot 540. However, the conditions for a canister purge are not met, as indicated by plot 530. Accordingly, the CPV duty cycle is maintained at 0%, as indicated by plot 560.

At time $t_1$, purging conditions are met, as indicated by plot 530. However, the vent line is blocked, as indicated by plot 510. As such, purging the fuel vapor canister with air drawn through the vent line is not feasible. Accordingly, a secondary method of purging the fuel vapor canister is engaged. The FTIV is opened, as indicated by plot 570. The CPV duty cycle is ramped up from 0%, as indicated by plot 560. Accordingly, the fuel tank pressure decreases, as indicated by plot 580. At time $t_2$, the fuel tank pressure reaches the vacuum threshold represented by line 585. At this vacuum threshold, the vacuum relief mechanism within the capless refueling unit opens, drawing fresh air into the fuel tank. Concurrently, the HEGO sensor increases above the rich threshold represented by line 593, indicating that fuel vapor is being drawn into the engine intake. The CPV duty cycle is thus maintained in order to maintain the vacuum relief mechanism open. The CPV duty cycle is maintained from time $t_2$ to time $t_3$. Both the total canister load and the canister buffer load decrease from time $t_2$ to time $t_3$, as indicated by plots 550 and 560, respectively. At time $t_3$, the HEGO sensor output decreased below the lean threshold represented by line 595, indicating that no additional fuel vapor is being drawn from the canister buffer into intake. Accordingly, the CPV duty cycle is decreased to zero. At time $t_4$, the FTIV is closed, after allowing for the fuel tank pressure to increase towards atmospheric pressure.

At time $t_5$, the engine is turned off, and purge conditions are no longer met. From time t5 to time $t_6$, the engine remains off. During this engine off period, fuel vapor adsorbed within the fuel vapor canister migrates to the canister buffer. As such, the canister buffer load increases, while the total canister load remains constant.

At time $t_6$, the vehicle engine is turned back on, as indicated by plot 520, and the canister load is above a threshold for purging, as indicated by plot 540. However, the conditions for a canister purge are not met, as indicated by plot 530. Accordingly, the CPV duty cycle is maintained at 0%, as indicated by plot 560.

At time $t_7$, purging conditions are met, as indicated by plot 530. However, as the vent line continues to be blocked, the secondary method of purging the fuel vapor canister is engaged. The FTIV is opened, as indicated by plot 570. The CPV duty cycle is ramped up from 0%, as indicated by plot 560. Accordingly, the fuel tank pressure decreases, as indicated by plot 580. At time $t_8$, the fuel tank pressure reaches vacuum threshold 585 and the HEGO sensor increases above the rich threshold represented by line 593, indicating that fuel vapor is being drawn into the engine intake. The CPV duty cycle is thus maintained in order to maintain the vacuum relief mechanism open. The CPV duty cycle is maintained from time $t_8$ to time $t_9$. Both the total canister load and the canister buffer load decrease from time $t_8$ to time $t_9$, as indicated by plots 550 and 560, respectively. At time $t_9$, the HEGO sensor output decreased below the lean threshold represented by line 595, indicating that no additional fuel vapor is being drawn from the canister buffer into intake. Accordingly, the CPV duty cycle is decreased to zero. At time $t_{10}$, the FTIV is closed, after allowing for the fuel tank pressure to increase towards atmospheric pressure.

The systems described herein and with regard to FIGS. 1, 2, and 4A-4D, along with the method described herein and with regard to FIG. 3 may enable one or more systems and one or more methods. In one example, a method for purging a fuel vapor canister buffer, comprising: opening a fuel tank isolation valve; opening a canister purge valve; and drawing a vacuum on a fuel tank sufficient to open a capless refueling assembly vacuum relief mechanism. Opening a canister purge valve may further comprise: ramping up a canister purge valve duty cycle until a first condition is met. The first condition may include a signal from an exhaust gas oxygen sensor indicating a richness of exhaust has increased above a first threshold. The method may further comprise: maintaining the canister purge valve duty cycle until receiving a signal from the exhaust gas oxygen sensor indicating a richness of exhaust has decreased below a second threshold, the second threshold lower than the first threshold. In some examples, the method may further comprise: following receiving a signal from the exhaust gas oxygen sensor indicating a richness of exhaust has decreased below the second threshold, closing the canister purge valve; and closing the fuel tank isolation valve. The method may further comprise: following closing the fuel tank isolation valve, maintaining the fuel tank isolation valve and canister purge valve closed for a predetermined duration; and then opening the fuel tank isolation valve; opening the canister purge valve; and drawing a vacuum on a fuel tank sufficient to open the capless refueling assembly vacuum relief mechanism. Drawing a vacuum on a fuel tank sufficient to open a capless refueling assembly vacuum relief mechanism may further comprise: drawing atmospheric air into the engine intake via a path that includes the capless refueling assembly, the fuel tank, and the fuel vapor canister buffer. The method may further comprise: while the fuel tank isolation valve is closed, drawing atmospheric air into the fuel tank via the capless refueling assembly responsive to a fuel tank vacuum above a threshold. The technical result of implementing this method is that the fuel vapor canister buffer may still be purged to intake even under conditions where the canister vent line is blocked. This will allow the vehicle to remain in use without increasing bleed emissions in the period between the diagnosis of the blocked vent line and the time when the user can bring the vehicle in for service.

In another example, a fuel system for a vehicle, comprising: a fuel tank coupled to a buffer of a fuel vapor canister; a capless refueling assembly coupled to the fuel tank, the capless refueling assembly configured to vent to atmosphere responsive to a fuel tank vacuum increasing above a threshold vacuum; an engine intake coupled to the fuel vapor canister; and a controller configured with instructions stored in non-transitory memory, that when executed, cause the controller to: during a first condition, apply a vacuum from the engine intake to the fuel tank such that the capless refueling assembly vents to atmosphere; and maintain applying vacuum from the engine intake to the fuel tank until a load of the buffer of the fuel vapor canister decreases below a threshold. The fuel system may further comprise: a vent line coupled between the fuel vapor canister and atmosphere; and the first condition may include a blocked vent line determination. In some example, the fuel system may further comprise: an evaporative leak check module coupled within the vent line, the evaporative leak check module comprising a pressure sensor; and the blocked vent line determination may include an air flow below a threshold during a purging operation, the air flow determined at the pressure sensor of the evaporative leak check module. The fuel system may further comprise: a temperature sensor coupled to the fuel vapor canister; and the blocked vent line determination may include an temperature change below a threshold during a purging operation, the temperature change determined at the temperature sensor coupled to the fuel vapor canister. In some example, the fuel system may further comprise: a canister purge valve coupled between the fuel vapor canister and the engine intake; a fuel tank isolation valve coupled between the fuel tank and the buffer of the fuel vapor canister; and applying a vacuum from the engine intake to the fuel tank may further comprise opening the canister purge valve and the fuel tank isolation valve. Opening the canister purge valve may further comprise: ramping up a duty cycle of the canister purge valve until the capless refueling assembly vents to atmosphere. Maintaining applying vacuum from the engine intake to the fuel tank may further comprise: following ramping up a duty cycle of the canister purge valve until the capless refueling assembly vents to atmosphere, maintaining the duty cycle of the canister purge valve. The controller may be further configured with instructions stored in non-transitory memory, that when executed, cause the controller to: responsive to the load of the buffer of the fuel vapor canister decreasing below a threshold, close the canister purge valve and the fuel tank isolation valve. In some examples, the controller may be further configured with instructions stored in non-transitory memory, that when executed, cause the controller to: following closing the canister purge valve and the fuel tank isolation valve, maintain the canister purge valve and fuel tank isolation valve closed; during a second condition, apply a vacuum from the engine intake to the fuel tank such that the capless refueling assembly vents to atmosphere; and maintain applying vacuum from the engine intake to the fuel tank until a load of the buffer of the fuel vapor canister decreases below a threshold. The second condition may follow the first condition by a predetermined duration, and the second condition may comprises a load of the buffer of the fuel vapor canister greater than the threshold. The technical result of implementing this system is that the fuel vapor canister may be partially purged to intake despite the canister vent line being blocked. Following a diurnal cycle, the fuel vapor remaining in the canister may migrate into the canister buffer. The cycle may then be repeated. In this way, the contents of the canister may be gradually purged to intake, decreasing bleed emissions that would otherwise occur if the vent line is blocked while the fuel vapor canister retained adsorbed fuel vapor.

In yet another example, a method for purging a fuel vapor canister, comprising: during a first condition, opening a fuel tank isolation valve; ramping up a canister purge valve duty cycle until a capless refueling assembly vents to atmosphere; drawing atmospheric air into the engine intake via a path that includes the capless refueling assembly, the fuel tank, and the fuel vapor canister buffer; drawing fuel vapor desorbed from the fuel vapor canister buffer into the engine intake; maintaining the canister purge valve duty cycle until an exhaust gas oxygen sensor indicates a richness of exhaust has decreased below a threshold; and then closing the fuel tank isolation valve and canister purge valve. The first condition may include: a fuel vapor canister load greater than a threshold; an engine intake vacuum greater than a threshold; and a blocked vent line condition. The technical result of implementing this method is a secondary canister vent line that may be realized without adding any additional hardware. This may improve vehicle evaporative emissions without increasing manufacturing costs.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for purging a fuel vapor canister buffer, comprising:

opening a fuel tank isolation valve;

opening a canister purge valve; and drawing a vacuum on a fuel tank sufficient to open a capless refueling assembly vacuum relief mechanism.

2. The method of claim 1, where opening the canister purge valve further comprises:

ramping up a canister purge valve duty cycle over time until a first condition is met.

3. The method of claim 2, where the first condition includes a signal from an exhaust gas oxygen sensor indicating a richness of exhaust has increased above a first threshold.

4. The method of claim 3, further comprising:

maintaining the canister purge valve duty cycle until receiving a signal from the exhaust gas oxygen sensor indicating a richness of exhaust has decreased below a second threshold, the second threshold lower than the first threshold.

5. The method of claim 4, further comprising:

following receiving the signal from the exhaust gas oxygen sensor indicating the richness of exhaust has decreased below the second threshold, closing the canister purge valve; and closing the fuel tank isolation valve.

6. The method of claim 5, further comprising:

following closing the fuel tank isolation valve, maintaining the fuel tank isolation valve and canister purge valve closed for a predetermined duration; and then opening the fuel tank isolation valve;

opening the canister purge valve; and drawing a vacuum on the fuel tank sufficient to open the capless refueling assembly vacuum relief mechanism.

7. The method of claim 1, where drawing the vacuum on the fuel tank sufficient to open the capless refueling assembly vacuum relief mechanism further comprises:

drawing atmospheric air into an engine intake via a path that includes a capless refueling assembly, the fuel tank, and the fuel vapor canister buffer.

8. The method of claim 5, further comprising:

while the fuel tank isolation valve is closed, drawing atmospheric air into the fuel tank via a capless refueling assembly responsive to a fuel tank vacuum above a threshold.

9. A fuel system for a vehicle, comprising:

a fuel tank coupled to a buffer of a fuel vapor canister;

a capless refueling assembly coupled to the fuel tank, the capless refueling assembly configured to vent to atmosphere responsive to a fuel tank vacuum increasing above a threshold vacuum;

an engine intake coupled to the fuel vapor canister;

a controller configured with instructions stored in non-transitory memory, that when executed, cause the controller to:

during a first condition, apply a vacuum from the engine intake to the fuel tank such that the capless refueling assembly vents to atmosphere; and maintain applying vacuum from the engine intake to the fuel tank until a load of the buffer of the fuel vapor canister decreases below a threshold; and a vent line coupled between the fuel vapor canister and atmosphere, wherein the first condition includes a blocked vent line determination.

10. The fuel system of claim 9, further comprising:

an evaporative leak check module coupled within the vent line, the evaporative leak check module comprising a pressure sensor; and wherein the blocked vent line determination includes an air flow below a threshold during a purging operation, the air flow determined at the pressure sensor of the evaporative leak check module.

11. The fuel system of claim 9, further comprising:

a temperature sensor coupled to the fuel vapor canister; and wherein the blocked vent line determination includes a temperature change below a threshold during a purging operation, the temperature change determined at the temperature sensor coupled to the fuel vapor canister.

12. The fuel system of claim 9, further comprising:

a canister purge valve coupled between the fuel vapor canister and the engine intake;

a fuel tank isolation valve coupled between the fuel tank and the buffer of the fuel vapor canister; and wherein applying the vacuum from the engine intake to the fuel tank further comprises opening the canister purge valve and the fuel tank isolation valve.

13. The fuel system of claim 12, wherein opening the canister purge valve further comprises:

ramping up a duty cycle of the canister purge valve until the capless refueling assembly vents to atmosphere.

14. The fuel system of claim 13, wherein maintaining applying vacuum from the engine intake to the fuel tank further comprises:

following ramping up the duty cycle of the canister purge valve until the capless refueling assembly vents to atmosphere, maintaining the duty cycle of the canister purge valve.

15. The fuel system of claim 14, where the controller is further configured with instructions stored in non-transitory memory, that when executed, cause the controller to:

responsive to the load of the buffer of the fuel vapor canister decreasing below the threshold, close the canister purge valve and the fuel tank isolation valve.

16. The fuel system of claim 15, where the controller is further configured with instructions stored in non-transitory memory, that when executed, cause the controller to:

following closing the canister purge valve and the fuel tank isolation valve, maintain the canister purge valve and fuel tank isolation valve closed;

during a second condition, apply a vacuum from the engine intake to the fuel tank such that the capless refueling assembly vents to atmosphere; and maintain applying vacuum from the engine intake to the fuel tank until a load of the buffer of the fuel vapor canister decreases below a threshold.

17. The fuel system of claim 16, wherein the second condition follows the first condition by a predetermined duration, and wherein the second condition comprises a load of the buffer of the fuel vapor canister greater than the threshold.

18. A method for purging a fuel vapor canister, comprising:

during a first condition, opening a fuel tank isolation valve;

ramping up a canister purge valve duty cycle until a capless refueling assembly vents to atmosphere;

drawing atmospheric air into an engine intake via a path that includes the capless refueling assembly, a fuel tank, and a fuel vapor canister buffer;

drawing fuel vapor desorbed from the fuel vapor canister buffer into the engine intake;

maintaining the canister purge valve duty cycle until an exhaust gas oxygen sensor indicates a richness of exhaust has decreased below a threshold; and then closing the fuel tank isolation valve and a canister purge valve.

19. The method of claim 18, where the first condition includes:

a fuel vapor canister load greater than a threshold;

an engine intake vacuum greater than a threshold; and a blocked vent line condition.

* * * * *